US011059006B2

(12) United States Patent
Rohn et al.

(10) Patent No.: US 11,059,006 B2
(45) Date of Patent: Jul. 13, 2021

(54) AGITATOR DEVICE

(71) Applicant: EKATO Ruehr- und Mischtechnik GmbH, Schopfheim (DE)

(72) Inventors: Nicole Rohn, Rheinfelden (DE); Hans-Juergen Weiss, Kandern (DE); Bernd Nienhaus, Wehr (DE)

(73) Assignee: EKATO Rühr- und Mischtechnik GmbH, Schopfheim (DE)

( * ) Notice: Subject to any disclaimer, the term of this patent is extended or adjusted under 35 U.S.C. 154(b) by 195 days.

(21) Appl. No.: 15/781,820

(22) PCT Filed: Nov. 10, 2016

(86) PCT No.: PCT/EP2016/077327
§ 371 (c)(1),
(2) Date: Jun. 6, 2018

(87) PCT Pub. No.: WO2017/097530
PCT Pub. Date: Jun. 15, 2017

(65) Prior Publication Data

US 2018/0345233 A1 Dec. 6, 2018

(30) Foreign Application Priority Data

Dec. 10, 2015 (DE) ..... 10 2015 121 513.6

(51) Int. Cl.
*B01F 7/00* (2006.01)
*B01F 7/16* (2006.01)
*B01F 7/22* (2006.01)

(52) U.S. Cl.
CPC ..... *B01F 7/168* (2013.01); *B01F 7/00366* (2013.01); *B01F 7/22* (2013.01)

(58) Field of Classification Search
CPC ..... B01F 7/168; B01F 7/22; B01F 7/00366; B01F 7/00375; B01F 7/00383
See application file for complete search history.

(56) References Cited

U.S. PATENT DOCUMENTS 1,850,199 A 3/1932 Bryant
4,328,175 A * 5/1982 Roeckel ..... B01F 3/04609 261/91

(Continued)

FOREIGN PATENT DOCUMENTS

DE 29821742 U1 3/1999
EP 0664155 A1 7/1995

(Continued)

OTHER PUBLICATIONS

Office Action dated Aug. 19, 2016 issued in corresponding DE patent application No. 10 2015 121 513.6 (and partial English translation).

(Continued)

*Primary Examiner* — Anshu Bhatia
(74) *Attorney, Agent, or Firm* — Posz Law Group, PLC

(57) ABSTRACT

An agitator device, in particular a draft tube agitator device, with at least one stirring unit, which is rotatable around a rotary axis, which is configured for conveying a fluid in an axial conveying direction and which includes at least one rotor blade element, the projection of said rotor blade element onto a plane that is perpendicular to the rotary axis having an at least substantially circular-arc-shaped outer contour, the rotor blade element comprises at least one first region, which is situated in a blade plane and is at least substantially planar, and includes a second region, which is curved out of the blade plane.

19 Claims, 5 Drawing Sheets

(56) References Cited

U.S. PATENT DOCUMENTS

Figure 1:
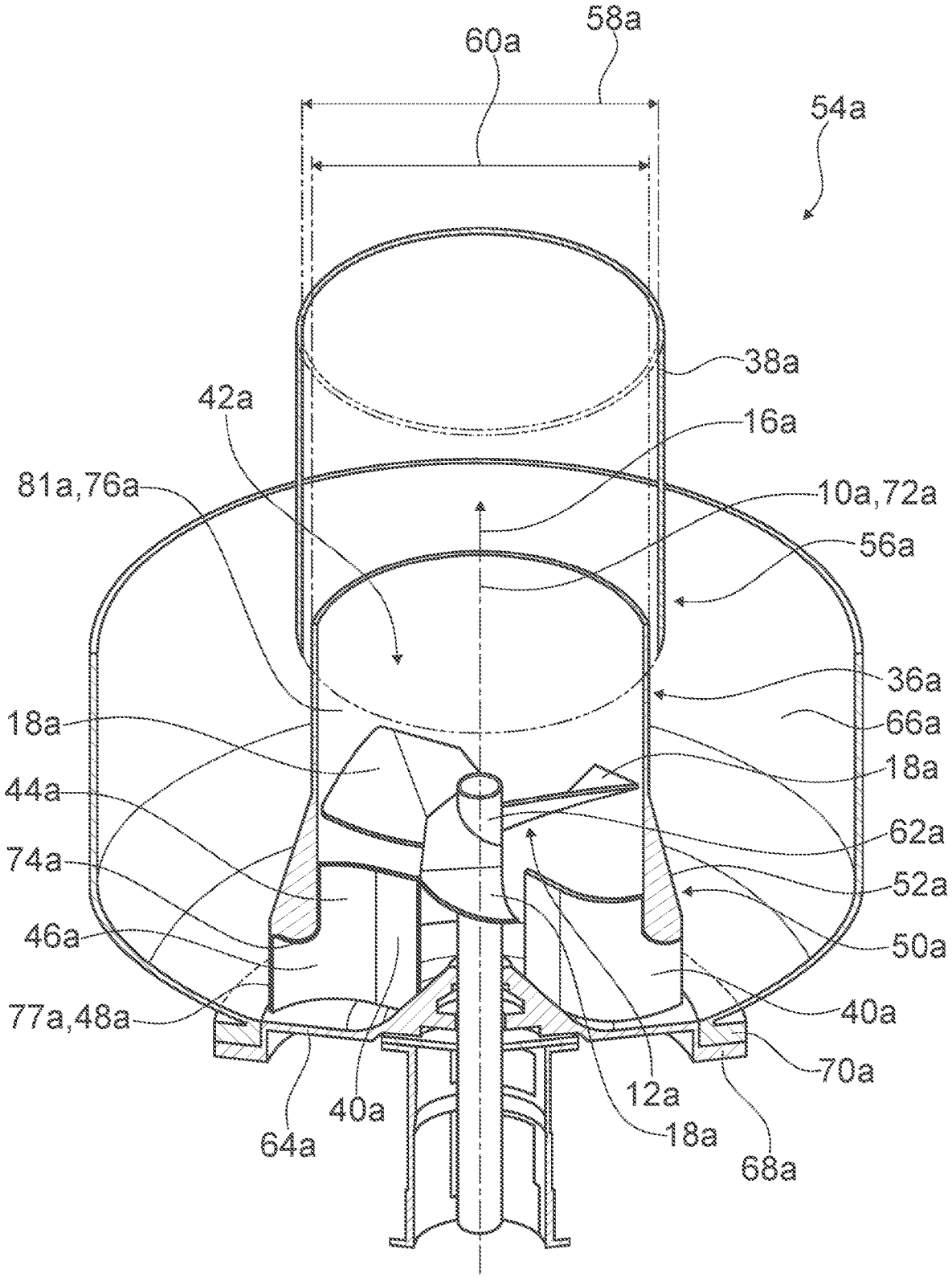

| | | | | |
|---|---|---|---|---|
| 4,358,206 | A | 11/1982 | Schutte | |
| 5,595,475 | A | 1/1997 | Weiss et al. | |
| 2009/0238033 | A1 | 9/2009 | Wyczalkowski | |
| 2009/0314698 | A1* | 12/2009 | Higbee | B01F 7/00341 210/150 |

FOREIGN PATENT DOCUMENTS

| | | | |
|---|---|---|---|
| EP | 0771586 | A1 | 5/1997 |
| KR | 101086555 | B1 | 11/2011 |
| WO | 96/20777 | A1 | 7/1996 |

OTHER PUBLICATIONS

International Search Report of the International Searching Authority dated May 4, 2017 issued in corresponding International Patent Application No. PCT/EP2016/077327.

International Preliminary Report on Patentability dated Jun. 12, 2018 issued in corresponding International Patent Application No. PCT/EP2016/077327.

Office Action dated Feb. 11, 2020 issued in corresponding BR patent application No. 112018011513-4 (and English translation).

Office Action dated Mar. 6, 2020 issued in corresponding RU patent application No. 2018124647 (and English summary).

Office Action dated Jul. 23, 2020 issued in corresponding DE patent application No. 10 2015 121 513.6 (and English translation).

Office Action dated Oct. 12, 2020 issued in corresponding CN patent application No. 201680081589.X (and English summary).

* cited by examiner

AGITATOR DEVICE

CROSS REFERENCE TO RELATED APPLICATIONS

This application is a U.S. national stage application of PCT/EP2016/077327 filed on Nov. 10, 2016, which is based on German Patent Application No. 10 2015 121 513.6 filed on Dec. 10, 2015, the contents of which are incorporated herein by reference.

STATE OF THE ART

The invention concerns an agitator device, in particular a draft tube agitator device, according to the preamble of claim 1.

From the state of the art draft tube mixers with a stirring device arranged in a draft tube are already known.

The objective of the invention is in particular to provide a generic agitator device with improved fluid-technical characteristics. The objective is achieved according to the invention by the characterizing features of patent claims 1 and 6 while advantageous implementations and further developments of the invention may be gathered from the subclaims.

Advantages of the Invention

The invention is based on an agitator device, in particular a draft tube agitator device, with at least one stirring unit, which is rotatable around a rotary axis, which is configured for conveying a fluid in an axial conveying direction and which comprises at least one rotor blade element, the projection of said rotor blade element onto a plane that is perpendicular to the rotary axis having an at least substantially circular-arc-shaped outer contour.

It is proposed that the rotor blade element comprises at least one first region, which is situated in a blade plane and is at least substantially planar, and comprises a second region, which is curved out of the blade plane.

"Configured" is in particular to mean specifically programmed, designed and/or equipped. By an object being configured for a certain function is in particular to be understood that the object fulfills and/or implements said certain function in at least one application state and/or operating state. An "agitator device" is in particular to mean an, in particular fully functional, component, in particular a structural and/or functional component, of a mixer and/or of an agitator, in particular for a fluid, with a maximum rotational speed of in particular 500 rpm, advantageously 200 rpm, especially advantageously 100 rpm, preferably 50 rpm. In particular, the agitator device may also comprise the entire mixer and/or the entire agitator. The agitator device is preferentially embodied as a draft tube agitator device. A "draft tube agitator device" is in particular to mean a structural and/or functional component of a draft tube mixer and/or of a draft tube agitator, in particular for a fluid. In particular, the draft tube agitator device may also comprise the entire draft tube mixer and/or the entire draft tube agitator. A "fluid" is in particular to mean, in this context, a liquid or a suspension or a dispersion, in particular with a liquid carrier agent. Especially preferentially the draft tube mixer and/or the draft tube agitator comprise/comprises at least one, in particular vertical, draft tube and/or at least one stirring container. By a "draft tube" is herein in particular a hollow cylinder to be understood which is configured for conveying a fluid, in particular in a vertical direction, in particular at least substantially parallel to a surface normal of a base. "At least substantially parallel" is herein in particular to mean an orientation of a direction relative to a reference direction, in particular in a plane, wherein the direction has a deviation with respect to the reference direction of in particular less than 8°, advantageously less than 5° and particularly advantageously less than 2°. In particular, a main extension direction of the draft tube extends in a vertical direction. By a "main extension direction" of an object is herein in particular a direction to be understood which extends parallel to a longest edge of a smallest imaginary rectangular cuboid just still completely enclosing the object.

The rotary axis advantageously extends, in at least one normal operating state of the agitator device, at least substantially parallel to a vertical direction, in particular parallel to the surface normal of a base. Preferably the stirring unit is embodied as a stirring device, in particular as a draft tube propeller. Particularly preferably the stirring unit comprises at least one hub element, which is in particular arranged centrally. Especially preferentially the rotary axis extends through the hub element. Advantageously the stirring unit, in particular the hub element of the stirring unit, is configured for mounting on at least one drive shaft. Especially advantageously the hub element is connected to the drive shaft via a force-fit and/or form-fit connection, e.g. by clamps and/or screws and/or by a tongue-and-groove connection. It is however also conceivable that the stirring unit, in particular the hub element of the stirring unit, is connected to the drive shaft in a one-part implementation. "In a one-part implementation" is in particular to mean at least by substance-to-substance bond, e.g. by a welding process, a gluing process, an injection-molding process and/or any other process that is deemed expedient by someone skilled in the art, and/or advantageously formed in one piece, e.g. by production from a cast and/or by production in a one-component or multi-component injection molding procedure, and advantageously formed of a single blank. In particular, the stirring unit is configured for stirring at a maximum rotational speed of 500 rpm, advantageously 200 rpm, especially advantageously 100 rpm, preferably 50 rpm. Preferentially the stirring unit is made at least to a large extent of a material that is resistant against, in particular organic, solvents and/or acids and/or bases, in particular of a ceramic or a ceramic composite material. Especially preferentially the stirring unit is made, at least to a large extent, of a metal and/or of a metal alloy, in particular of steel and/or stainless steel. It is however also conceivable that the stirring unit is made, at least to a large extent, of a synthetic material. It is furthermore conceivable that the stirring unit comprises an, in particular additional, at least partial coating, e.g. of a metal oxide and/or of an, in particular corrosion-resistant, polymer, and/or is implemented in a rubberized fashion. The term "at least to a large extent" is herein in particular to mean by at least 55%, advantageously at least 65%, preferably by at least 75%, particularly preferably by at least 85% and especially advantageously by at least 95%. A conveying direction preferably extends at least substantially parallel to the rotary axis.

By an object being "at least substantially circular-arc-shaped" is in particular to be understood, in this context, that a smallest circular arc section encompassing the object has an inner radius and an outer radius which differ from one another by maximally 20%, advantageously by maximally 15%, especially advantageously by maximally 10%, preferably by maximally 5% and particularly preferably by maximally 2%. Advantageously a projection of the rotor blade element onto at least one plane comprising the rotary axis comprises at least one upper side or underside which is at least substantially straight. Preferably the rotor blade element is made, at least to a large extent, of a material that is resistant against, in particular organic, solvents and/or acids and/or bases, in particular of a ceramic or of a ceramic composite material. Especially preferentially the rotor blade element is made, at least to a large extent, of a metal and/or of a metal alloy, in particular of steel and/or stainless steel. It is however also conceivable that the rotor blade element is made, at least to a large extent, of a synthetic material. It is furthermore conceivable that the rotor blade element comprises an, in particular additional, at least partial coating, e.g. of a metal oxide and/or of an, in particular corrosion-resistant, polymer, and/or is implemented in a rubberized fashion. Advantageously the rotor blade element is connected to the hub element in a one-part implementation. It is however also conceivable that the rotor blade element is connected to the hub element by screws and/or rivets.

In particular, the blade plane corresponds to a main extension plane of the first region. By a "main extension plane" of an object is in particular a plane to be understood which is parallel to a largest side surface of a smallest imaginary rectangular cuboid just still completely enclosing the object, and which in particular extends through the center point of the rectangular cuboid. Advantageously the first region and the second region implement the rotor blade element. Especially advantageously the second region has an at least substantially constant curvature radius. An "at least substantially constant value" is in particular to mean, in this context, a variation of said value by maximally 20%, advantageously by at least 15%, especially advantageously by at least 10% and preferably by no less than 5%. Preferably an imaginary delimitation line between the first region and the second region has an at least substantially straight course. By an "at least substantially straight course" of a line is herein in particular to be understood that a smallest rectangular cuboid encompassing the line has at least a longest side that is at least ten times as long, advantageously at least 20 times as long, especially advantageously at least 50 times as long, preferably at least 100 times as long and particularly preferably at least 200 times as long as a second-longest side of the rectangular cuboid, and that for any point of the line an angle between a tangent in the point and the longest side of the rectangular cuboid is maximally 10°, advantageously maximally 8°, particularly advantageously no more than 5°, preferably maximally 3° and particularly preferably no more than 2°. Especially preferentially the second region comprises at least one corner, particularly preferably exactly two corners, of the rotor blade element. The first region and/or the second region advantageously extend/extends over an entire width of the rotor blade element.

By the implementation according to the invention in particular an advantageous flow is achievable in a mixing and/or stirring. Furthermore, a high performance rate is advantageously achievable. Advantageously it is possible to adapt a geometry in a simple manner. In particular, a high homogeneity of a flow velocity is advantageously achievable. Furthermore, an advantageous homogenization of a mixed fluid is achievable. In particular, dead spaces and/or caking and/or encrustations are/is avoidable. Moreover a homogeneous flow is achievable, in particular in a draft tube. Furthermore a conveyance is achievable that is gentle on the product, and/or shearing forces acting, for example, on stirred and/or growing particles and/or crystals, are reducible.

In an advantageous embodiment of the invention it is proposed that the second region is arranged radially farther outward than the first region. Preferably the first region has, on at least one side, an outer contour that is configured for a form-fit connection to the hub element. Preferably the second region has the circular-arc-shaped outer contour. In this way a high conveying performance is advantageously achievable. Moreover this advantageously allows achieving a homogeneous conveyance of a fluid.

In a particularly advantageous implementation of the invention it is proposed that the rotor blade element comprises an inner edge facing toward the rotary axis and an outer edge facing away from the rotary axis, which is longer than the inner edge. Advantageously the inner edge extends, over at least a large extent of its length, along the hub element. Especially advantageously the inner edge and/or the outer edge are/is embodied at least substantially in a shape of an ellipse arc. By an object being "at least substantially in a shape of an ellipse arc" is in particular to be understood, in this context, that a smallest ellipse annulus section encompassing the object has an inner edge and an outer edge extending at a distance that is equivalent to maximally 20%, advantageously to maximally 15%, especially advantageously to maximally 10%, preferably to no more than 5% and particularly preferably to maximally 2% of a length of the outer edge. In this way it is advantageously possible to provide a rotor blade with a large conveyance area. Moreover, this advantageously allows achieving a flow-technically favorable geometry, which is in particular capable of favorably influencing a secondary flow and/or improving a performance rate.

Preferably at least a large portion of the rotor blade element has an at least substantially constant blade thickness. "At least a large portion" is to mean, in this context, in particular at least 60%, advantageously at least 70%, especially advantageously at least 80%, preferably no less than 90% and particularly preferably no less than 95%. In particular, the rotor blade element may have a differing blade thickness in a region of an edge or of a plurality of edges. By a "blade thickness" is in particular, in this context, a thickness of the rotor blade element to be understood, in particular a thickness along a direction that extends at least substantially parallel to a surface normal of an upper side and/or an underside of the rotor blade element. Herein the terms "upper side" and "underside" in particular refer to a view of the rotor blade element towards the rotary axis. Advantageously the rotor blade element is implemented as an at least partially curved plate and/or as an at least partially curved metal sheet. In this way, in a production, saving on costs and/or time is advantageously achievable. Furthermore this advantageously allows achieving a high degree of rigidity.

Particularly preferably there is at least one projection of at least a large portion of the rotor blade element onto at least one plane, for which the projected blade thickness is constant. In particular, there is at least one viewing direction along which a thickness of the rotor blade element is equivalent to a blade thickness. This advantageously allows reducing complexity of a production process.

In a further aspect, the invention is based on an agitator device, in particular a draft tube agitator device, with at least one stirring unit which is rotatable around a rotary axis, which is configured for conveying a fluid in an axial conveying direction, and which comprises at least one rotor blade element, whose projection onto a plane that is perpendicular to the rotary axis comprises an at least substantially circular-arc-shaped outer contour.

It is proposed that the agitator device comprises a sleeve unit, which is configured for a connection to a draft tube, which comprises at least one frontal guide sheet that is arranged in the conveying direction upstream of the stirring unit, and which defines an inner space which, in a mounted state, the stirring unit and at least one first region of the guide sheet are arranged in.

Advantageously the agitator device comprises at least one bottom unit, which is configured for a connection, in particular a one-part implementation and/or a force-fit and/or a form-fit connection, with the sleeve unit, e.g. via welding and/or screwing and/or clamping and/or riveting. Especially advantageously the agitator device comprises a container unit which is configured for a connection, in particular a one-part implementation, with the bottom unit and/or the sleeve unit. The bottom unit preferably comprises a circumferential flange, which is in a mounted state connectable to the container unit, in particular to a circumferential flange of the container unit.

Preferentially the sleeve unit is pluggable into a draft tube. Especially preferentially the sleeve unit has, at least in an upper region, an outer cross section that corresponds to an inner cross section of the draft tube. Advantageously, in the upper region an outer diameter of the sleeve unit corresponds to an inner diameter of the draft tube. By "at least substantially" is in particular to be understood, in this context, that a deviation from a given value is equivalent to in particular less than 15%, preferably less than 10% and particularly preferably less than 5% of the given value. In particular, in the mounted state the upper region of the sleeve unit is located within the draft tube.

The sleeve unit preferably encompasses the inner space at least on all sides in parallel towards the rotary axis. Advantageously a projection of the sleeve unit onto a plane that is perpendicular to the rotary axis completely encompasses a projection of the stirring unit onto the plane. In particular, an area content of a difference area of a smallest circle encompassing a projection of the stirring unit onto a plane that is perpendicular to the rotary axis and an inner cross section of the sleeve unit perpendicular to the rotary axis amounts to maximally 20%, advantageously no more than 15%, especially advantageously no more than 10%, preferably maximally 5% and particularly preferably no more than 3% of an area content of the inner cross section of the sleeve unit. Preferentially the sleeve unit is made, at least to a large extent, of a material that is resistant against, in particular organic, solvents and/or acids and/or bases, in particular of a ceramic material or a ceramic composite material. Particularly preferentially the sleeve unit is made of a metal and/or of a metal alloy, in particular of steel and/or stainless steel. It is however also conceivable that the sleeve unit is made, at least to a large extent, of a synthetic material. It is furthermore conceivable that the rotor blade element comprises an, in particular additional, at least partial coating, for example of a metal oxide and/or of an, in particular corrosion-resistant, polymer, and or is implemented in a rubberized fashion. Advantageously a projection of the sleeve unit onto a plane that is perpendicular to the rotary axis has an at least substantially circle-shaped inner cross section and/or an at least substantially circle-shaped outer cross section. By an "at least substantially circle-shaped cross section" of an object is herein in particular to be understood that, for at least 60%, advantageously for at least 70%, especially advantageously for no less than 80% and preferentially for at least 90% of all cross sections of the object along at least one direction, an area content of a difference area of the cross section and a smallest circle encompassing the cross section is maximally 30%, advantageously maximally 20%, especially advantageously no more than 10% and preferably maximally 5% of the area content of the circle. Preferentially the sleeve unit comprises at least one rear guide sheet, which is in a mounted state arranged in the conveying direction downstream of the stirring unit. Especially preferentially the rear guide sheet is in the mounted state arranged in the inner space.

Advantageously at least a large portion of the guide sheet has an at least substantially constant thickness. In particular, the guide sheet may have a differing thickness in a region of an edge or of a plurality of edges. Especially advantageously the guide sheet is embodied of a plate and/or of a metal sheet. Preferentially the guide sheet is made, at least to a large extent, of a material that is resistant against, in particular organic, solvents and/or acids and/or bases, in particular of a ceramic or of a ceramic composite material. Particularly preferably the guide sheet is made, at least to a large extent, of a metal and/or of a metal alloy, in particular of steel and/or stainless steel. It is however also conceivable that the guide sheet is made, at least to a large extent, of a synthetic material. In particular, when viewed perpendicularly to the rotary axis, an area content of the first region of the guide sheet is equivalent to at least 10%, advantageously at least 20%, especially advantageously at least 30% of an area content of the guide sheet. Preferentially the first region of the guide sheet and/or at least a perpendicular projection of the guide sheet onto a plane that is perpendicular to the rotary axis comprise/comprises an at least substantially rectangular cross section. By an "at least substantially rectangular cross section" of an object is herein in particular to be understood that, for at least 60%, advantageously for at least 70%, especially advantageously for at least 80% and preferably for at least 90% of all cross sections of the object along at least one direction, an area content of a difference area of the cross section and a smallest rectangle encompassing the cross section amounts to maximally 30%, advantageously maximally 20%, especially advantageously no more than 10%, preferably maximally 5% and especially advantageously no more than 5% of the area content of the rectangle. Preferentially, in the mounted state at least one side of the first region of the guide sheet extends at least substantially parallel to the rotary axis. In particular, it is also conceivable that the agitator device is mounted and/or is implemented to be operable in such a way that an alternative second conveyance of a fluid is effected in an alternative second conveying direction, which is in particular oriented counter to the conveying direction. The guide sheets may in this case in particular be located downstream of the agitator device in the alternative second conveying direction. Moreover, a geometry of the sleeve unit may in this case in particular be implemented unchanged and/or be implemented as described here and/or at least have a changed geometry of the guide sheet.

An implementation according to the invention in particular allows achieving an advantageous flow during mixing and/or stirring. Furthermore a high performance rate is advantageously achievable. Advantageously a geometry is adaptable in a simple manner. Especially advantageously dimensions of the stirring unit are precisely adaptable to dimensions of a conveying space and/or mixing space. In particular, a high homogeneity of a flow velocity is advantageously achievable. Further an advantageous homogenization of a mixed fluid is achievable. In particular, dead spaces and/or caking and/or encrustations are/is avoidable. Beyond this, a homogeneous flow, in particular in a draft tube, is advantageously achievable. Advantageously it is furthermore possible to achieve a conveyance that is gentle on the product, and/or to reduce shear forces acting, for example, onto stirred and/or growing particles and/or crystals.

It is further proposed that the inner space is embodied at least substantially cylinder-shaped. By an "at least substantially cylinder-shaped object" is herein in particular to be understood that a differential volume of the object and a smallest cylinder enclosing the object is maximally 30%, advantageously maximally 20%, especially advantageously no more than 10% and preferably maximally 5% of the volume of the cylinder. In particular, a smallest circle encompassing a projection of the stirring unit onto a plane that is perpendicular to the rotary axis has a radius that is smaller by maximally 20%, advantageously maximally 10%, especially advantageously no more than 5% and preferably no more than 3% than a radius of a smallest cylinder enclosing the inner space. Preferentially the rotary axis implements a cylinder axis of the cylinder. This advantageously allows achieving a precisely adapted geometry. Moreover, in this way the sleeve unit is advantageously adaptable to the stirring unit.

It is also proposed that, in the mounted state, a main extension plane of the guide sheet is arranged at least substantially parallel to the conveying direction. Advantageously, at least for a large portion of all points of the guide sheet, a surface normal through the respective point extends at least substantially perpendicularly to the rotary axis. This advantageously allows feeding a fluid to the stirring unit and/or to a mixing space and/or conveying space. Moreover, this allows achieving a favorable flow of the fluid. Beyond this, a largely homogeneous flow velocity is advantageously achievable in this way.

Furthermore it is proposed that a projection of the guide sheet onto a plane that is perpendicular to the rotary axis follows a curved course. Preferably a projection of the guide sheet onto a plane that is perpendicular to the rotary axis features a thickness at least substantially corresponding to a thickness of the guide sheet. Advantageously, a projection of the guide sheet onto a plane that is perpendicular to the rotary axis comprises at least one first, planar region and at least one second, curved region. Especially advantageously the curved course has an at least substantially constant curvature radius. This advantageously allows achieving a high torsional rigidity and/or a high strength. In this way furthermore a favorable incident flow to the stirring unit is advantageously achievable.

In a preferred implementation of the invention it is proposed that the guide sheet comprises at least one second region, which is in the mounted state arranged upstream of the inner space in the conveying direction and which extends farther than the inner space in a radial direction. Preferentially a partial region of the second region, which is located radially farther outward than the inner space, has in a view of the guide sheet along the rotary axis a curved region. In particular, an extension of the second region along the rotary axis is equivalent to at least 10%, advantageously at least 20%, especially advantageously at least 30%, preferably at least 40% and particularly preferably at least 50% of an extension of the guide sheet along the rotary axis. An "extension along a direction" of an object is in particular to mean, in this context, a maximum distance of two points of a perpendicular projection of the object onto a plane that is oriented parallel to the direction. In this way a fluid is advantageously conveyable to the stirring unit from below. In a particularly preferred implementation of the invention it is proposed that the sleeve unit has, on an in the conveying direction frontal end, a radial extension that corresponds to a distance of a point of the guide sheet which is radially the farthest away from the rotary axis, to the rotary axis. Advantageously a radially farthest edge of a projection of the guide sheet onto a plane that is perpendicular to the rotary axis is situated on a smallest circle enclosing a projection of the sleeve unit onto the plane. Especially advantageously a radially farthest edge of the guide sheet extends at least substantially parallel to the rotary axis. This allows making a flow-technically favorable geometry of the sleeve unit available, in particular in an entry region of a fluid.

It is also proposed that the sleeve unit has, on an in the conveying direction front side, an outer contour which is implemented at least substantially in the shape of a truncated-cone envelope. In particular, an extension of the outer contour along a direction that is parallel to the rotary axis is equivalent to at least 10%, advantageously at least 20%, especially advantageously at least 30%, preferably at least 40% and particularly preferably at least 50% of an extension of the sleeve unit along the direction. Advantageously an angle included by the truncated-cone envelope and a cone axis amounts to maximally 45°, especially advantageously maximally 30°, preferably no more than 20° and particularly preferably no less than 15°. This advantageously allows increasing a stability of the sleeve unit.

Beyond this it is proposed that the sleeve unit has an extension along the conveying direction that is at least twice as large, advantageously at least three times as large, especially advantageously at least four times as large, preferably at least five times as large and particularly preferably at least six times as large as an extension of the stirring unit along the conveying direction. This advantageously allows achieving a homogeneous flow velocity.

Moreover a mixer, in particular a draft tube mixer, is proposed, with at least one agitator device and with the draft tube that comprises, in a region of the connection with the sleeve unit, an inner cross section that corresponds at least substantially to an outer cross section of the sleeve unit in the region of the connection.

Furthermore a method for a production of at least one intermediate and/or end product from at least one initial product, by means of the agitator device, is proposed, wherein the initial product is stirred by means of the stirring unit. Preferably the initial product is embodied as a fluid. In this way a high-grade product quality and/or homogeneity are/is achievable. This further allows achieving a time- and/or cost-efficient production.

The agitator device according to the invention is herein not to be limited to the application and implementation form described above. In particular, to fulfill a functionality that is described here, the agitator device according to the invention may comprise a number of individual elements, structural components and units that differs from a number that is mentioned here.

DRAWINGS

Further advantages will become apparent from the following description of the drawings. In the drawings two exemplary embodiments of the invention are shown. The drawings, the description and the claims contain a plurality of features in combination. Someone skilled in the art will purposefully also consider the features separately and will find further expedient combinations.

Figure 2:
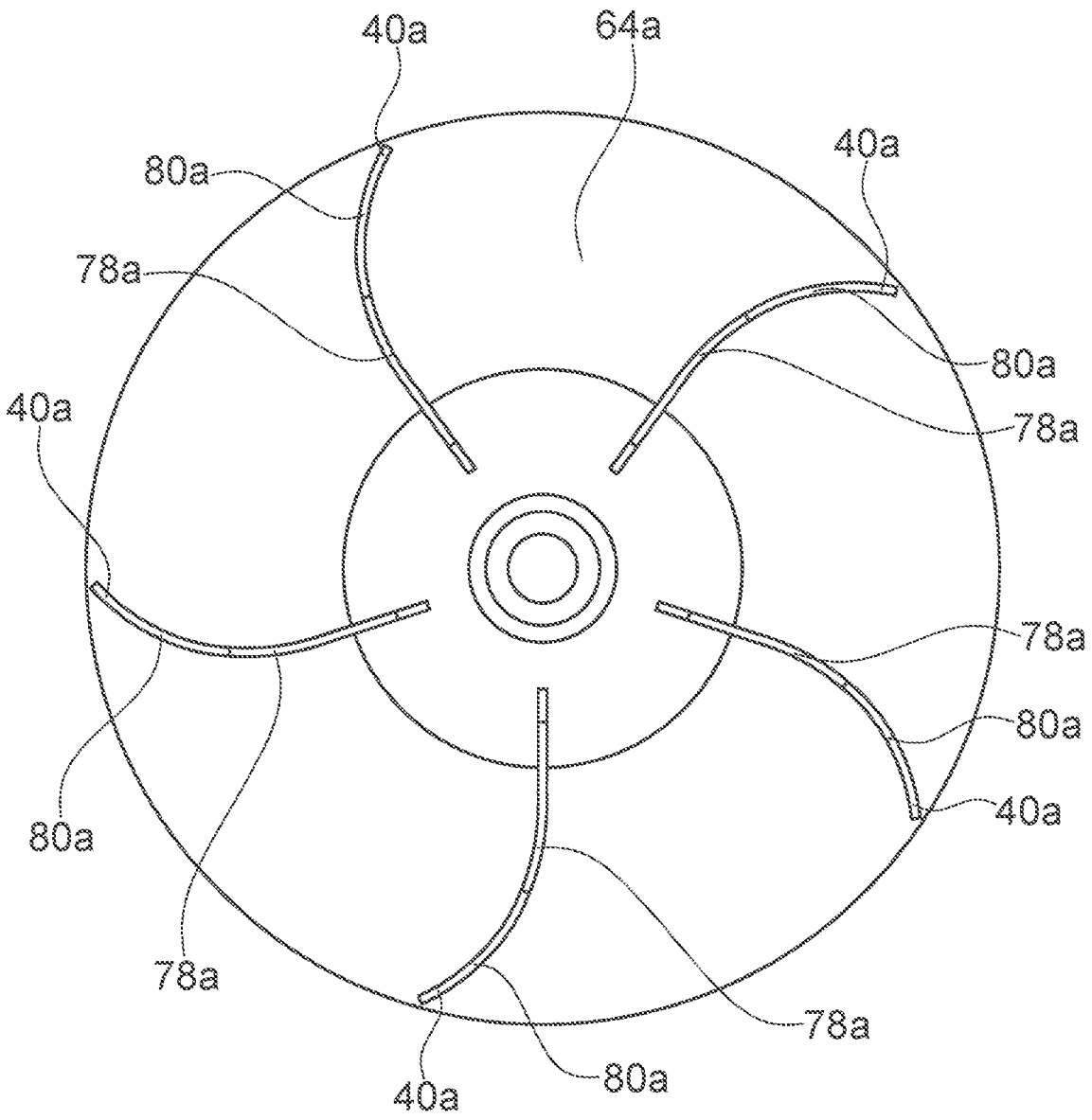
Figure 3:
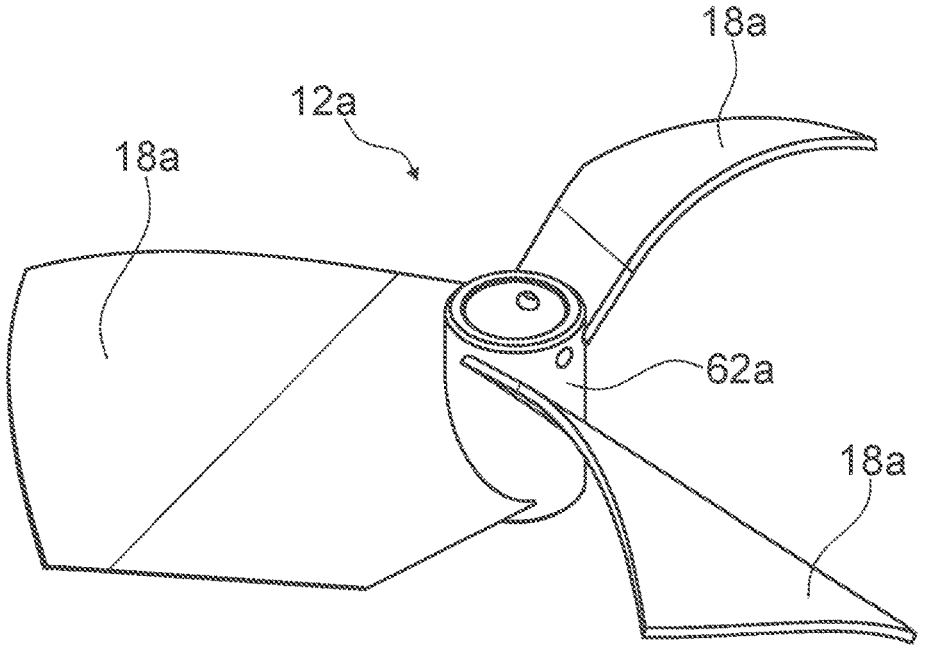
Figure 4:
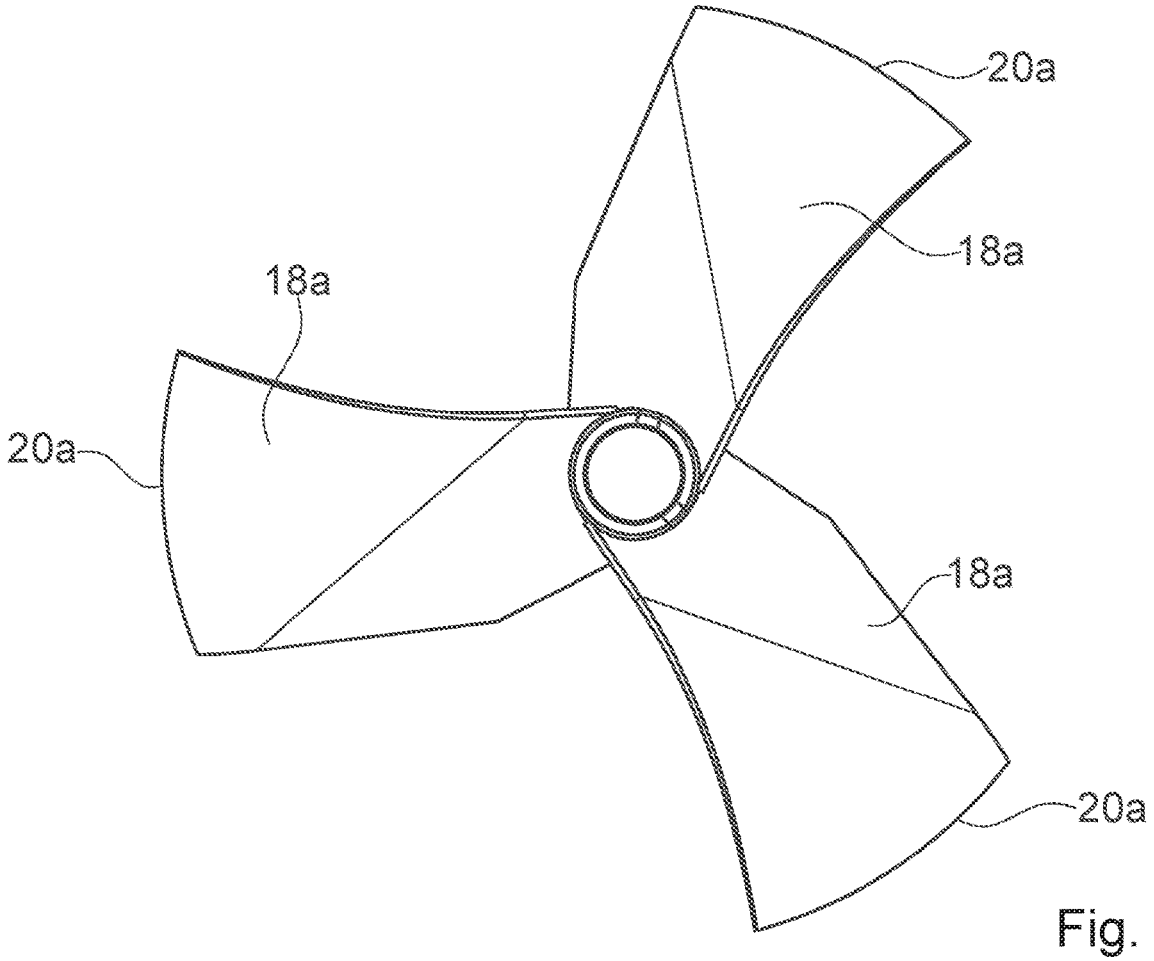
Figure 5:
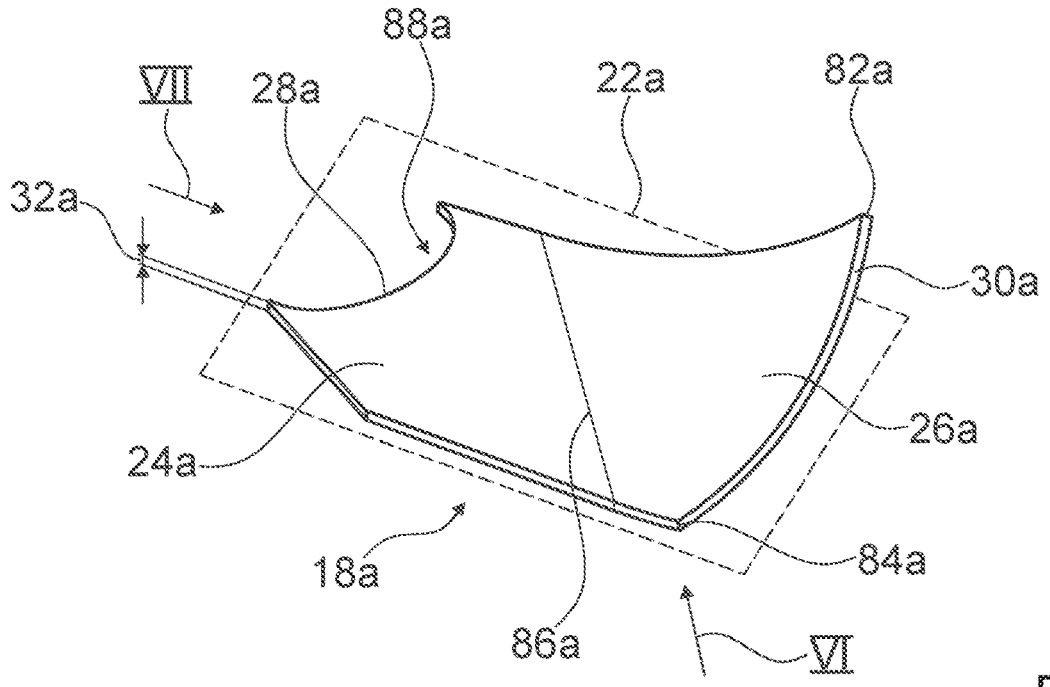
Figure 6:
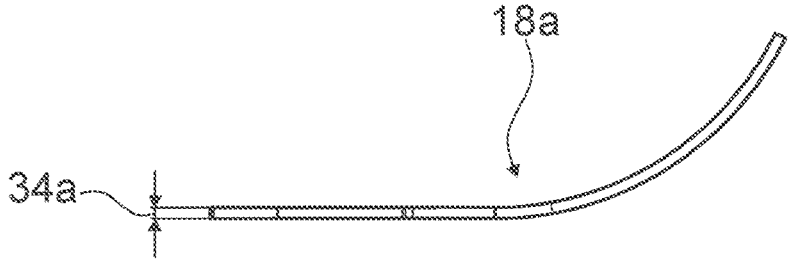
Figure 7:
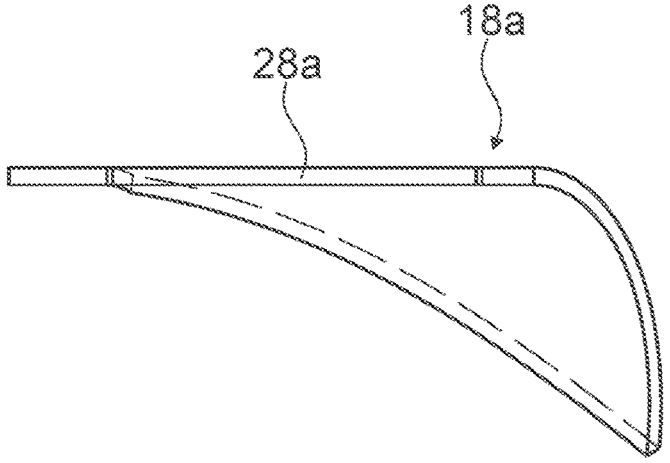
Figure 8:
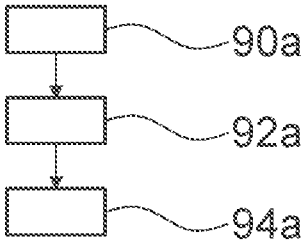
Figure 9:
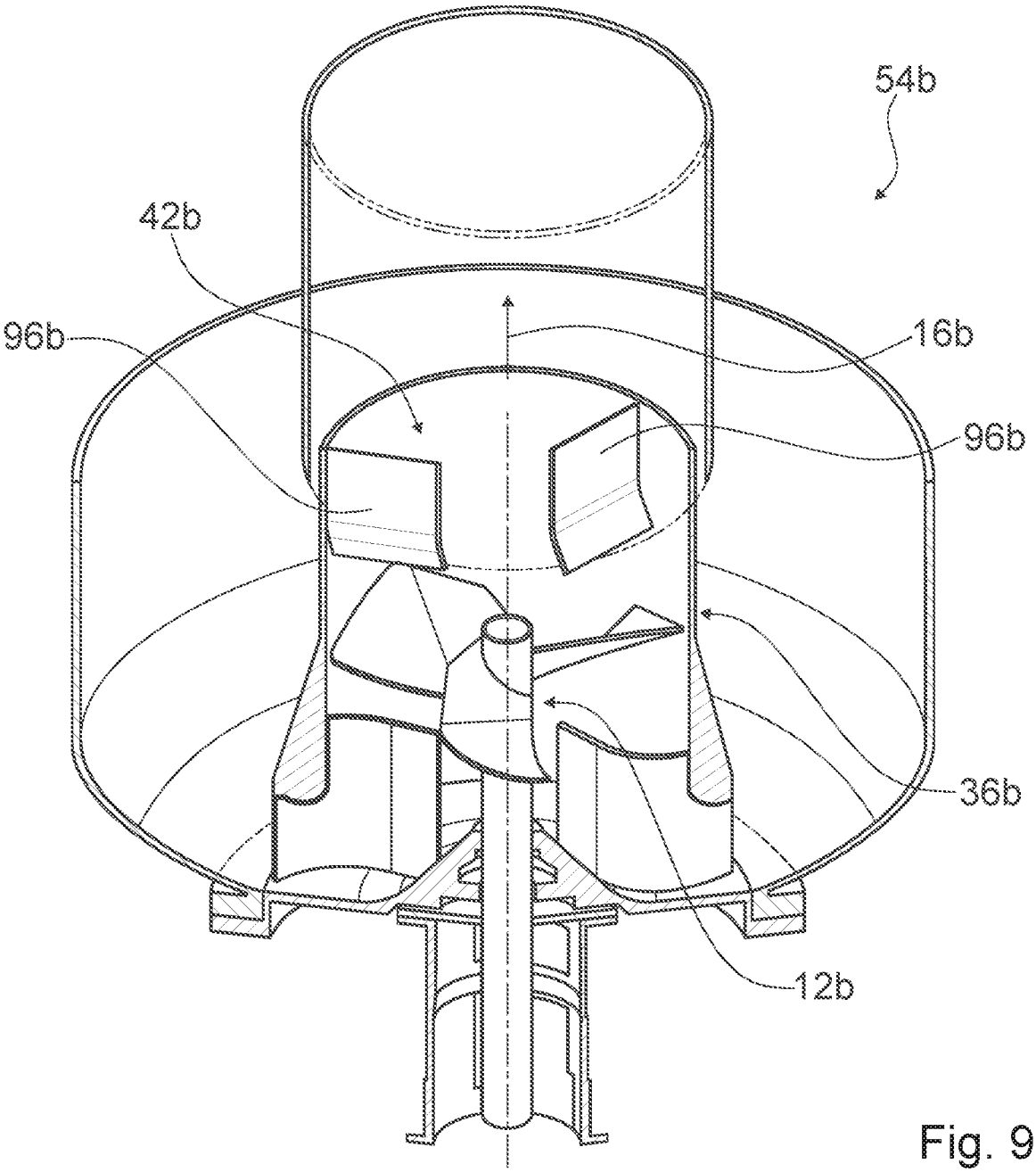

It is shown in:

FIG. 1 a mixer with an agitator device in a perspective sectional representation, FIG. 2 an arrangement of guide sheets of a sleeve unit of the agitator device, in a schematic top view, FIG. 3 a stirring unit of the agitator device, in a perspective view, FIG. 4 the stirring unit in a schematic top view, FIG. 5 a rotor blade element of the stirring unit, in a perspective view, FIG. 6 the rotor blade element, viewed along a direction VI in FIG. 5, FIG. 7 the rotor blade element, viewed along a direction VII in FIG. 5, FIG. 8 an exemplary flow chart for a method for a production of a product from an initial product by the agitator device, and FIG. 9 an alternative mixer with an alternative agitator device in a perspective sectional representation.

DESCRIPTION OF THE EXEMPLARY EMBODIMENTS

In the exemplary embodiment described below there is more than one item of some of the structural units and/or structural components, For the sake of simplification, analogously implemented structural components and/or structural units provided with the same reference numerals in the drawings will be described only once in the following description of the drawings.

FIG. 1 shows a mixer 54*a* with an agitator device in a perspective sectional representation. The mixer 54*a* comprises a draft tube 38*a*. In the present case, a main extension direction of the draft tube 38*a* extends in a vertical direction. The agitator device is embodied as a draft tube agitator device. The agitator device comprises a stirring unit 12*a*, which is embodied to be rotatable around a rotary axis 10*a*. The stirring unit 12*a* comprises a centrally arranged hub element 62*a*. Furthermore the stirring unit 12*a* comprises, in the present case, three rotor blade elements 18*a*. However, a different number of rotor blade elements is also conceivable like, for example, two or four or five or six or eight or ten. The stirring unit 12*a* is configured for conveying a fluid (not shown in FIG. 1) in a conveying direction 16*a*. In the present case, the conveying direction 16*a* extends at least substantially parallel to a vertical direction. The conveying direction 16*a* extends in the present case parallel to the rotary axis 10*a*. The conveying direction 16*a* extends in the present case upwards. It is however also conceivable that a conveying direction extends downwards.

In the present case the agitator device comprises a bottom unit 64*a*. The bottom unit 64*a* comprises a circumferential flange 68*a*. The agitator device further comprises a container unit 66*a*. The container unit 66*a* comprises a circumferential flange 70*a*. The container unit 66*a* is connected to the flange 68*a* of the bottom unit 64*a* via the flange 70*a* of the container unit 66*a*.

The agitator device comprises a sleeve unit 36*a*. In the present case the sleeve unit 36*a* comprises a wall element 76*a*. Furthermore, the sleeve unit 36*a* is in the present case connected to the bottom unit 64*a*. The sleeve unit 36*a* defines an inner space 42*a*. In the present case the wall element 76*a* defines the inner space 42*a*. Moreover, the inner space 42*a* is in the present case embodied to be cylinder-shaped. Moreover, the rotary axis 10*a* implements in the present case a cylinder axis 72*a* of the inner space 42*a*. The sleeve unit 36*a* is configured for a connection to the draft tube 38*a*. The draft tube 38*a* has, in a region 56*a* of the connection with the sleeve unit 36*a*, an inner cross section 58*a* which corresponds at least substantially to an outer cross section 60*a* of the sleeve unit 36*a* in the region 56*a* of the connection.

The sleeve unit 36*a* comprises a guide sheet 40*a*. A main extension plane of the guide sheet 40*a* extends in parallel to the conveying direction 16*a*. The guide sheet 40*a* comprises a first region 44*a*, which is arranged within the inner space 42*a*. A projection of the first region 44*a* onto a plane that is parallel to the rotary axis 10*a* has an at least substantially rectangular cross section. The guide sheet 40*a* comprises a second region 46*a*, which is arranged upstream of the inner space 42*a* in the conveying direction 16*a*. The second region 46*a* extends farther than the inner space 42*a* in the radial direction. The guide sheet 40*a* is connected to the wall element 76*a* in a form-fit fashion. In the present case the sleeve unit 36*a* comprises in total five guide sheets 40*a*, which are embodied at least substantially identically (cf. FIG. 2). In a case when a conveying direction is oriented in an opposite direction, at least one guide sheet may have a curvature that differs from the one described here and/or may be embodied in such a way that it is adapted to a changed flow.

On an in the conveying direction 16*a* front end 74*a*, the sleeve unit 36*a* has a radial extension that corresponds to a distance of a point 48*a* of the guide sheet 40*a*, which is radially the farthest away from the rotary axis 10*a*, from the rotary axis 10*a*. In the present case the point 48*a* is located on a radially outer edge 77*a* of the guide sheet 40*a*.

On an in the conveying direction 16*a* front side 50*a*, the sleeve unit 36*a* has an outer contour 52*a* which is implemented at least substantially in the shape of a truncated cone envelope. In the present case an angle between the truncated-cone envelope and a cone axis is approximately 18°. Furthermore, the cone axis is in the present case equivalent to the rotary axis 10*a*. Furthermore the sleeve unit 36*a* has, along the conveying direction 16*a*, an extension that is at least twice as great, in the present case approximately seven times as great as an extension of the stirring unit 12*a* along the conveying direction 16*a*.

In the present case the stirring unit 12*a*, the sleeve unit 36*a*, the bottom unit 64*a*, the container unit 66*a* and the draft tube 38*a* are embodied at least to a large extent of stainless steel.

FIG. 2 shows an arrangement of the guide sheets 40*a* of the sleeve unit 36*a* in a schematic top view, viewed towards the rotary axis 10*a* (cf. FIG. 1). The guide sheets 40*a* are distributed equally along a circumference of the bottom unit 64*a*. Viewed towards the rotary axis 10*a* (cf. FIG. 1), the guide sheets 40*a* respectively have a first region 78*a*, located radially inside and featuring a straight course, and have a second region 80*a*, located radially outside and featuring a curved course. The second region 80*a* respectively has a constant curvature radius. In the present case all points of the first region 78*a* are located radially farther inside, with respect to the rotary axis 10*a*, than an inner wall 81*a* of the wall element 76*a* (cf. FIG. 1).

FIG. 3 shows the stirring unit 12*a* of the agitator device in a perspective view. The rotor blade elements 18*a* of the stirring unit 12*a* are in the present case welded to the hub element 62*a* of the stirring unit 12*a*. In the present case the stirring unit 12*a* has a diameter of approximately 500 mm. It is however also conceivable that a stirring unit has a different diameter like, for example, a diameter of approximately 250 mm or a diameter of approximately 1000 mm or a diameter of approximately 1500 mm or a diameter of approximately 2000 mm or a diameter of approximately 3000 mm.

FIG. 4 shows the stirring unit 12*a* in a schematic top view, viewed along the rotary axis 10*a* (cf. FIG. 1). Viewed towards the rotary axis 10*a* (cf. FIG. 1), each rotor blade element 18*a* respectively has a circular-arc shaped outer contour 20*a*.

FIG. 5 shows one of the rotor blade elements 18*a* of the stirring unit 12*a* in a perspective view. The rotor blade element 18*a* has a constant blade thickness 32*a*. In the present case the blade thickness of the rotor blade element 18*a* is approximately 5 mm. It is however also conceivable that a rotor blade has a different blade thickness like, for example, a blade thickness of approximately 2 mm or a blade thickness of approximately 10 mm or a blade thickness of approximately 20 mm or a blade thickness of approximately 30 mm or a blade thickness of approximately 50 mm or a blade thickness of approximately 70 mm. The rotor blade element 18*a* comprises a planar first region 24*a* situated in a blade plane 22*a* and comprises a second region 26*a* that is curved out of the blade plane 22*a*. The first region 24*a* and the second region 26*a* together form the rotor blade element 18*a*. In the present case two corners 82*a*, 84*a* of the rotor blade element 18*a* are curved out of the blade plane 22*a*. Furthermore, the second region 26*a* comprises in the present case the two corners 82*a*, 84*a*. An imaginary delimitation line 86*a* between the first region 24*a* and the second region 26*a* features a straight course. The first region 24*a* comprises an ellipse-arc-shaped partial region 88*a*, which is configured for a form-fit connection to the hub element 62*a* of the stirring unit 12*a*. Relative to the rotary axis 10*a* (cf. FIG. 1), the second region 26*a* is arranged radially farther outwards than the first region 24*a*.

The rotor blade element 18*a* comprises an inner edge 28*a* that faces towards the rotary axis 10*a* (cf. FIG. 1) as well as an outer edge 30*a* that faces away from the rotary axis 10*a* (cf. FIG. 1) and is longer than the inner edge 28*a*.

FIG. 6 shows the rotor blade element 18*a*, viewed along a direction VI of FIG. 5. A projection of the rotor blade element 18*a* onto a plane that is perpendicular to the direction VI of FIG. 5 features a constant projected blade thickness 34*a*. In the present case the projected blade thickness 34*a* corresponds to the blade thickness 32*a*.

FIG. 7 shows the rotor blade element 18*a*, viewed along a direction VII of FIG. 5. A projection of the inner edge 28*a* of the rotor blade element 18*a* onto a plane that is perpendicular to the direction VII of FIG. 5 has a straight course.

FIG. 8 shows an exemplary flow chart for a method for a production of a product and/or of an intermediate product from at least one initial product, by means of the agitator device. In a first method step 90*a* the initial product is provided. In a second method step 92*a* the initial product is stirred by the stirring unit 12*a* of the agitator device. In a third method step 94*a* a further processing and/or a finalization of the product and/or the intermediate product are/is carried out. It is conceivable that the method steps 90*a*, 92*a*, 94*a* are passed through iteratively. Furthermore, permanent in-feeding of the initial product and/or permanent conveying away of the intermediate product and/or of the product are/is conceivable.

In FIG. 9 another exemplary embodiment of the invention is shown. The following description and the drawing are substantially limited to the differences between the exemplary embodiments, wherein regarding structural components having the same designation, in particular regarding structural components having the same reference numerals, the drawings and/or the description of the other exemplary embodiment, in particular of FIGS. 1 to 8, may principally also be referred to. To distinguish between the exemplary embodiments, the letter a has been added to the reference numerals of the exemplary embodiment of FIGS. 1 to 8. In the exemplary embodiment of FIG. 9 the letter a has been substituted with the letter b.

FIG. 9 shows an alternative mixer 54*b* with an alternative agitator device in a perspective sectional view. The agitator device comprises a stirring unit 12*b*, which is configured for conveying a fluid (not shown) in a vertical conveying direction 16*b*. The alternative agitator device comprises a sleeve unit 36*b*. The sleeve unit 36*b* defines an inner space 42*b*. The sleeve unit 36*b* comprises rear guide sheets 96*b*, which are arranged downstream of the stirring unit 12*b* in the conveying direction 16*b*. The guide sheets 96*b* are arranged in the inner space 42*b*.

REFERENCE NUMERALS

10 rotary axis
12 stirring unit
16 conveying direction
18 rotor blade element
20 outer contour
22 blade plane
24 first region
26 second region
28 inner edge
30 outer edge
32 blade thickness
34 projected blade thickness
36 sleeve unit
38 draft tube
40 guide sheet
42 inner space
44 first region
46 second region
48 point
50 side
52 contour
54 mixer
56 region
58 cross section
60 cross section
62 hub element
64 bottom unit
66 container unit
68 flange
70 flange
72 cylinder axis
74 front end
76 wall element
77 edge
78 first region
80 second region
81 wall
82 corner
84 corner
86 delimitation line
88 partial region
90 method step
92 method step
94 method step
96 guide sheet

The invention claimed is:

1. An agitator device with at least one stirring unit, which is rotatable around a rotary axis, is configured for conveying a fluid in an axial conveying direction and comprises at least one rotor blade element, wherein a projection of said rotor blade element onto a plane that is perpendicular to the rotary axis has an at least substantially circular-arc-shaped outer contour, the rotor blade element comprises an inner edge facing toward the rotary axis, wherein the inner edge is embodied at least substantially in a shape of an ellipse arc, and the rotor blade element comprises at least one first region, wherein an outer surface of the first region is situated in a blade plane and is at least substantially planar, and a second region, wherein an outer surface of the second region is curved out of the blade plane.

2. The agitator device according to claim 1, wherein the second region is arranged radially farther outward than the first region.

3. The agitator device according to claim 1, wherein the inner edge faces toward the rotary axis and an outer edge faces away from the rotary axis, wherein the outer edge is longer than the inner edge.

4. The agitator device according to claim 1, wherein at least a large portion of the rotor blade element has an at least substantially constant blade thickness.

5. The agitator device according to claim 4, wherein there is at least one projection of at least a large portion of the rotor blade element onto at least one plane, for which the projected blade thickness is constant.

6. The agitator device according to claim 1, further comprising a sleeve unit, which is configured for a connection to a draft tube, wherein the sleeve unit comprises at least one guide sheet that is arranged in the conveying direction upstream of the stirring unit and defines an inner space wherein, in a mounted state, the stirring unit and at least one first region of the guide sheet are arranged in the inner space.

7. The agitator device according to claim 6, wherein the inner space is at least substantially cylinder-shaped.

8. The agitator device according to claim 6, wherein, in the mounted state, a main extension plane of the guide sheet is arranged at least substantially parallel to the conveying direction.

9. The agitator device according to claim 6, wherein a projection of the guide sheet onto a plane that is perpendicular to the rotary axis follows a curved course.

10. The agitator device according to claim 6, wherein the guide sheet comprises at least one second region, which is in the mounted state arranged upstream of the inner space in the conveying direction and which extends farther than the inner space in a radial direction.

11. The agitator device according to claim 6, wherein the sleeve unit has a radial extension that corresponds to a distance from the rotary axis to a point of the guide sheet that is radially the farthest away from the rotary axis at a frontal end of the sleeve unit with respect to the conveying direction.

12. The agitator device according to claim 11, wherein a radially farthest edge of a projection of the guide sheet onto a plane that is perpendicular to the rotary axis is situated on a smallest circle enclosing a projection of the sleeve unit onto the plane.

13. The agitator device according to claim 12, wherein the radially farthest edge of the guide sheet extends at least substantially parallel to the rotary axis.

14. The agitator device according to claim 6, wherein the sleeve unit has, on the conveying direction front side, an outer contour which is implemented at least substantially in the shape of a truncated-cone envelope.

15. The agitator device according to claim 6, wherein the sleeve unit has an extension along the conveying direction that is at least twice as large as an extension of the stirring unit along the conveying direction.

16. A mixer with at least one agitator device according to claim 6 and with the draft tube that comprises, in a region of the connection with the sleeve unit, an inner cross section corresponding at least substantially to an outer cross section of the sleeve unit in the region of the connection.

17. A method for a production of at least one intermediate and/or end product from at least one initial product, by means of an agitator device according to claim 1, wherein the initial product is stirred by means of the stirring unit.

18. The agitator device according to claim 1, wherein the second region is located radially outside and featuring a curved course with a constant curvature radius.

19. The agitator device according to claim 1, wherein the second region comprises two corners of the rotor blade element which are curved out of the blade plane.

* * * * *